US005816860A

United States Patent [19]

Blanche

[11] Patent Number: 5,816,860

[45] Date of Patent: Oct. 6, 1998

[54] PLURAL SOCKET RECEPTACLE

[75] Inventor: Stephen A. Blanche, Warwick, R.I.

[73] Assignee: Etco Incorporated, Warwick, R.I.

[21] Appl. No.: 689,907

[22] Filed: Aug. 15, 1996

[51] Int. Cl.[6] ..... H01R 25/00

[52] U.S. Cl. ..... 439/652

[58] Field of Search ..... 439/650, 651, 439/652, 653, 654, 655, 373

[56] References Cited

U.S. PATENT DOCUMENTS

| | | | |
|---|---|---|---|
| 1,568,156 | 1/1926 | Herskovitz | 439/652 |
| 3,005,179 | 10/1961 | Holt | 439/652 |
| 4,293,172 | 10/1981 | Lingaraju | 439/652 |
| 4,948,376 | 8/1990 | Penning | 439/650 |
| 5,443,400 | 8/1995 | Brown et al. | 439/652 |

*Primary Examiner*—Gary F. Paumen
*Assistant Examiner*—Tho D. Ta

[57] ABSTRACT

An electrical receptacle for a plurality of plugs includes insulatively spaced conductive contact elements each including one of a pair of plug receptive forks, different forks extending in different and non-parallel directions.

8 Claims, 3 Drawing Sheets

PLURAL SOCKET RECEPTACLE

FIELD

This invention relates to receptacles for pluralities of electrical plugs.

BACKGROUND

The assignee of this invention has sold receptacles which provide three sockets in a line, opening into one planar face of each receptacle, one fork of each of the three sockets being provided by a first metal stamping, the other fork of each of the sockets being provided by a second metal stamping identical with the first stamping except for plug blade width, the stampings being held in spaced insulative relation by cast polyvinyl chloride, that relation being that the stampings are relatively inverted, in a thickness direction of the receptacle; are spaced in a thickness direction, and generally parallel, to take advantage of the insulation; and are spaced longitudinally to provide for the proper spacing for plugs between forks and for a receptacle between plug blades.

SUMMARY

I have discovered that yet more compact, and generally advantageous, receptacles may be provided by providing a pair of stampings in which the receptacle openings are not coplanar.

In a preferred embodiment, the two stampings are identical except for blade width, and each has a longitudinal portion with, extending from it longitudinally of each end and transversely spaced two prong receptive forked ends or forks, and extending from it transversely slightly displaced from its transverse centerline a third prong receptive forked portion and, oppositely transversely directed, a power plug blade, and the two stampings are held in an insulating plastic body transversely spaced and longitudinally and thickness-wise reversely oriented with respect to each other.

PREFERRED EMBODIMENT

There follows description of the preferred embodiment, shown in the drawings.

DRAWINGS

DESCRIPTION

Figure 1:
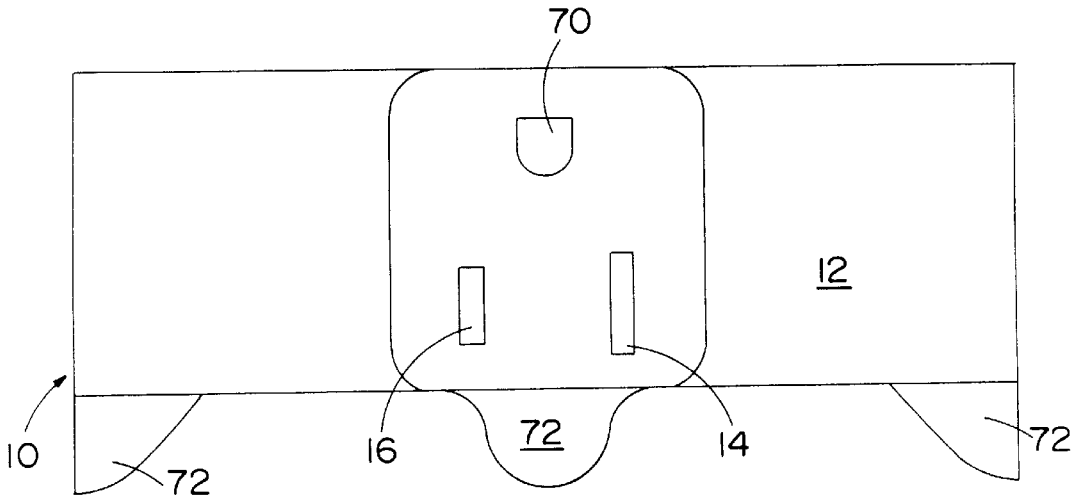
FIG. 1 is a plan view of said preferred embodiment.

There is shown in FIG. 1 a plan view of the preferred receptacle, indicated generally at 10. It includes a molded polyvinyl chloride insulative body 12 with wider power prong hole 14 and narrower power prong hole 16.

Figure 2:
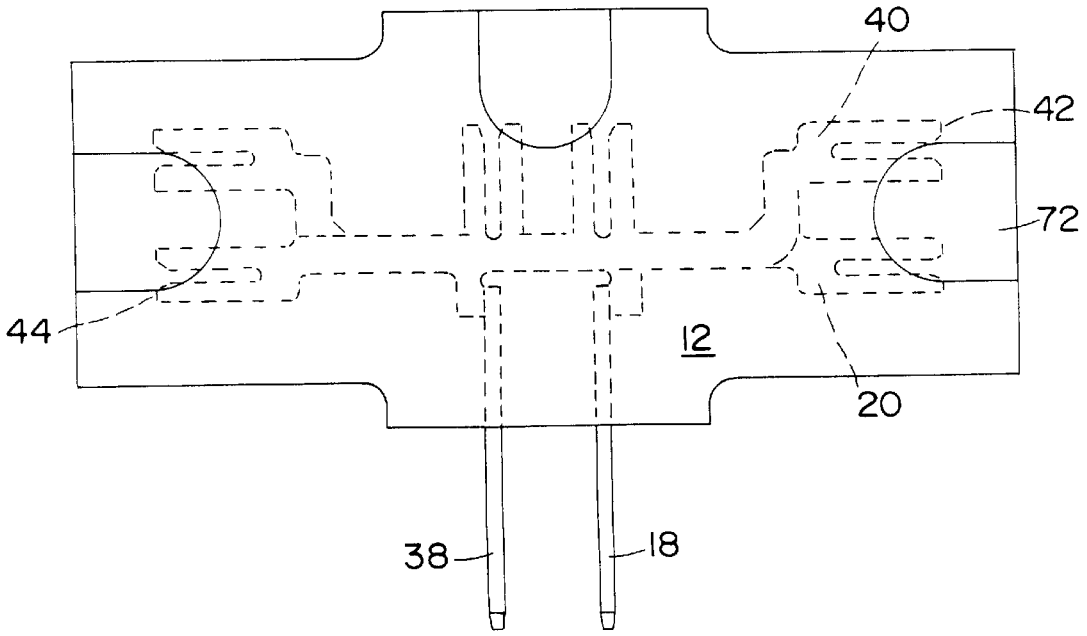
FIG. 2 is a side elevation view thereof, showing the reversed stampings.
Figure 3:
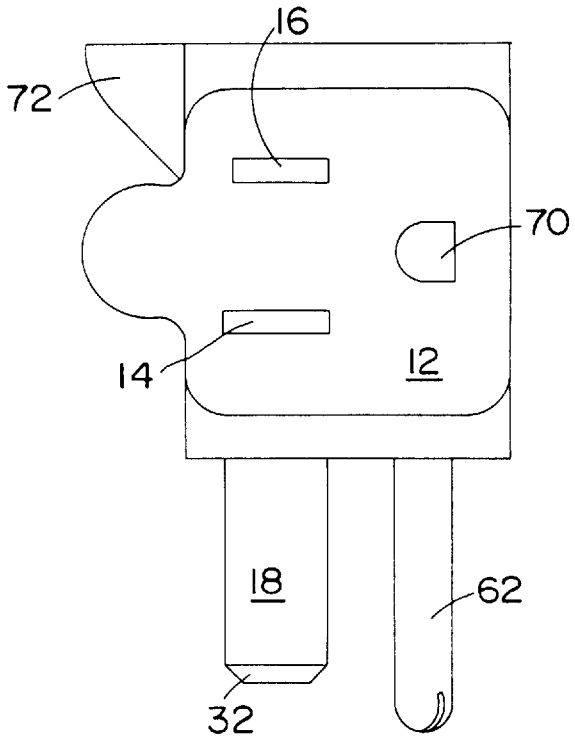
FIG. 3 is an end elevation view thereof.
Figure 4:
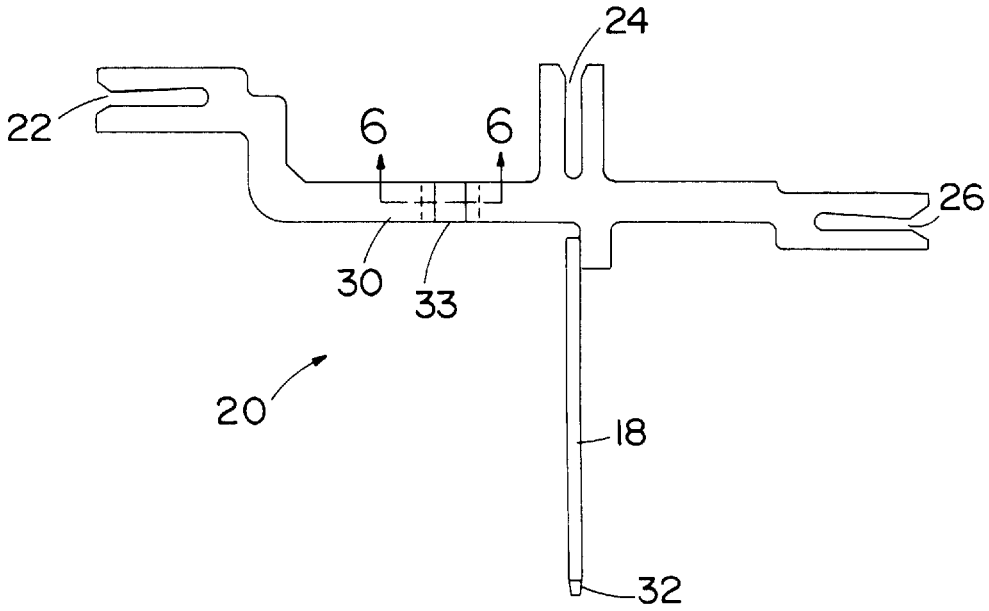
FIG. 4 is a side elevation view, to slightly reduced scale, of the contact element which includes the right hand prong of FIG. 1.
Figure 5:
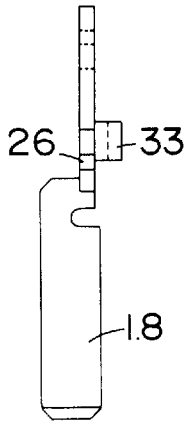
FIG. 5 is an end elevation view of said contact element.
Figure 6:
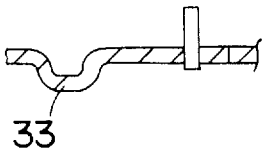
FIG. 6 is a partial sectional view taken at 6—6 of FIG. 4.

Prong 18, shown in FIG. 2, is a part of a contact element indicated generally at 20 in FIG. 4. Element 20 is a brass stamping of uniform thickness which includes also tines defining slots 22, 24, 26, each sized to yieldingly engage one prong of an electrical plug. Slots 22 and 26 are oppositely facing, and at opposed ends of the longitudinally extending contact element 20. Slots 22 and 26 have parallel, transversely spaced, axes. Longitudinally between slots 22 and 26, extending along a transverse line rightwardly spaced from the longitudinal center of contact element 20, and coaxial with prong 18, is slot 24. Prong 18 is bent 90 degrees relative to the longitudinal portion 30 including slots 22 and 26 about a transverse axis generally coaxial with slot 24, and ends in bevel 32. Longitudinal portion 30 has also, formed therein, trough 33, which extends transversely of portion 30 in a direction receptacle thickness-wise oppositely to prong 18 therefrom, and spaced on the other side of the longitudinal center of said contact element 20 a distance generally corresponding to, but in the opposite longitudinal direction from, that of prong 18.

Contact element 40, which includes prong 38, extends longitudinally parallel with contact element 20, each with upper and lower surfaces lying in four parallel planes and with end surfaces lying in a first pair of vertical planes and side surfaces defining a second pair of vertical planes perpendicular to the first pair. Contact elements 20 and 40 are however differently oriented in the plastic body 12 maintaining both in position. The transverse centerline of element 40 (not drawn in) lies parallel to ends 42 and 44 and half way both between them and between its upper and lower surfaces. Element 40 is oriented relative to element 20 by having been in effect rotated 180 degrees about the transverse axis just discussed, and positioned vertically above contact element 20.

Prong 18 thus extends from contact element 20, while prong 38 extends similarly from contact element 40, to together provide a power plug for insertion into a wall socket. Each of the slots of each contact element 20 and 40 cooperates with an adjacent slot of the other to define a plug receptacle, three in all, each oriented in a direction 90 degrees from that of its neighbor.

Prong 38 is identical with prong 18 except that its width is ¼ inch rather than 5/16 inch, the width of prong 18—conventional widths, with conventional tolerances, for conventional sockets. Sheet and thus prong thicknesses are also conventional.

Figure 7:
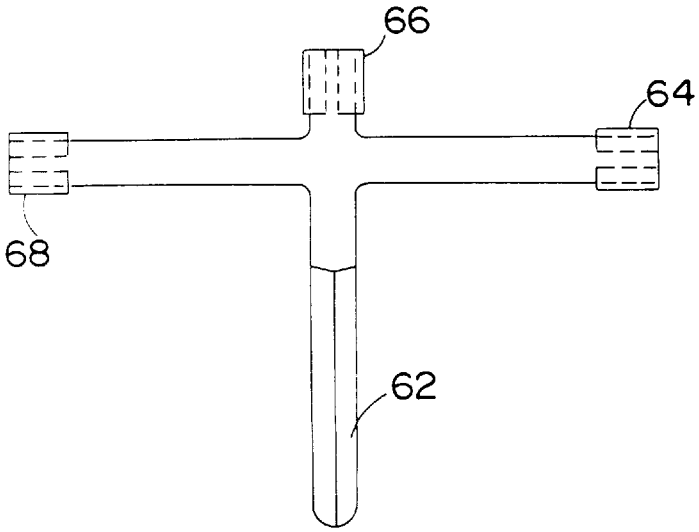
FIG. 7 is a plan view of the ground element of said preferred embodiment.
Figure 8:
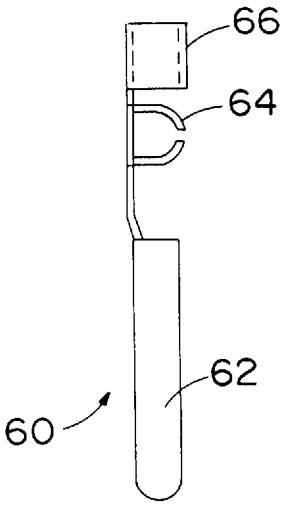
FIG. 8 is an end elevational view of said ground element.

Also fixedly positioned in the polyvinyl chloride body 12, insulatively spaced thereby from power contact elements 20 and 40, is ground contact element 60, also formed from sheet brass as shown in FIGS. 7 and 8 to provide round male ground contact 62 and female contacts 64, 66, and 68.

Body 12 includes also ground contact receptive holes 70 and integral bosses 72.

Other embodiments of the invention are within the claims.

I claim:

1. An electrical plug receptacle which comprises a first contact element, a second contact element, and a body portion, said body portion holding said first contact element and said second contact element in a fixed relative relationship, each said contact element including a first plug prong receptive slot and a second plug prong receptive slot, the two first slots having parallel axes extending in a first direction, the two second slots having parallel axes extending in a second direction, said two first slots being insulatively separated and relatively positioned to provide together a first plug receptacle, and said two second slots being insulatively separated and relatively positioned to provide together a second plug receptacle.

2. The plug receptacle of claim 1 in which each of said contact elements includes a third plug prong receptive slot having an axis along one of said first and second directions.

3. The plug receptacle of claim 2 in which said first slot and said third slot extend longitudinally of said contact elements opening at opposite longitudinal ends of said contact elements.

4. The plug receptacle of claim 3 in which said first slot and said third slot are transversely spaced a distance corresponding to the slot spacing of said plug receptacle.

5. The plug receptacle of claim 4 in which both contact elements are identical in each element therein specified.

6. The receptacle of claim 5 in which a plug prong extends from each said contact element opposite said second slot.

7. The receptacle of claim 6 in which each said plug prong is integral with and twisted 90 degrees relative to the rest of a said contact element.

8. The receptacle of claim 7 in which said first contact element and said second contact element are related as by rotating one about its transverse axis relative to the other.

* * * * *

UNITED STATES PATENT AND TRADEMARK OFFICE

CERTIFICATE OF CORRECTION

PATENT NO. : 5,816,860

DATED : October 6, 1998

INVENTOR(S) : Stephen A. Blanche

It is certified that error appears in the above-indentified patent and that said Letters Patent is hereby corrected as shown below:

Title page item [73], "Etco" should be --ETCO--;

Col. 2, between lines 63 and 64, should be inserted --each said contact element being an integral one-piece thin flat conductor having a body with a thickness outlined in an irregular periphery,--;

between lines 65 and 66, should be inserted --each of said slots being defined by said periphery, and extending in a non-thickness and bodily inward direction into said body of its said contact element,--;

Col. 3, line 5, after "receptacle" delete "and"; and between lines 5 and 6, should be inserted --said body is of plastic and holds said contact elements in a fixed relative relationship, said first direction is perpendicular to said second direction, and--.

Signed and Sealed this

Twenty-third Day of February, 1999

*Attest:*

Q. TODD DICKINSON

*Attesting Officer*

*Acting Commissioner of Patents and Trademarks*